US006002112A

United States Patent [19]

Nass et al.

[11] Patent Number: 6,002,112

[45] Date of Patent: Dec. 14, 1999

[54] COOKING APPLIANCE, SUCH AS A STOVE, WITH A GLASS-CERAMIC HOB OR COOKTOP WITH A RAPID COOKING RING OR HOTPLATE

[75] Inventors: Peter Nass; Patrick Hoyer, both of Mainz; Kurt Schaupert, Hofheim-Wallau, all of Germany

[73] Assignee: Schott Glass, Mainz, Germany

[21] Appl. No.: 09/022,918

[22] Filed: Feb. 12, 1998

[30] Foreign Application Priority Data

Feb. 13, 1997 [DE] Germany ..... 29702418

[51] Int. Cl.[6] ..... H05B 3/68

[52] U.S. Cl. ..... 219/443.1; 219/452.11

[58] Field of Search ..... 219/443.1, 460.1, 219/461.1, 465.1, 466.1, 467.1, 468.1, 468.2; 126/39 H, 39 N, 39 J, 90 A, 92 AC

[56] References Cited

U.S. PATENT DOCUMENTS

| | | | |
|---|---|---|---|
| 2,640,906 | 6/1953 | Haynes | 219/466.1 |
| 3,733,462 | 5/1973 | Bouchard et al. | 219/465.1 |
| 4,527,050 | 7/1985 | Kicherer | 219/466.1 |
| 4,960,978 | 10/1990 | Lorenz et al. | 219/466.1 |
| 5,268,338 | 12/1993 | Gerberick | 501/109 |
| 5,402,767 | 4/1995 | Kahlke . | |
| 5,468,290 | 11/1995 | Kelley | 106/635 |
| 5,679,273 | 10/1997 | Petein | 219/466.1 |

FOREIGN PATENT DOCUMENTS

| | | |
|---|---|---|
| 0069298 | 1/1983 | European Pat. Off. . |
| 3049491 | 12/1981 | Germany . |
| 3503647 | 8/1986 | Germany . |
| 8915365 | 9/1990 | Germany . |
| 19500449 | 7/1996 | Germany . |

*Primary Examiner*—Sam Paik
*Attorney, Agent, or Firm*—Nils H. Ljungman & Associates

[57] ABSTRACT

A cooking appliance with a glass-ceramic hob having a plurality of cooking zones at least one of which cooking zones is designated as a rapid cooking zone. The cooking zones can be heated essentially by electrically operated heating devices, and the rapid cooking zone is formed by a ceramic hot plate integrated into the glass-ceramic hob.

20 Claims, 1 Drawing Sheet

COOKING APPLIANCE, SUCH AS A STOVE, WITH A GLASS-CERAMIC HOB OR COOKTOP WITH A RAPID COOKING RING OR HOTPLATE

BACKGROUND OF THE INFORMATION

1. Field of the Invention

The present invention relates generally to a cooking appliance with a glass-ceramic hob or cooktop having a plurality of cooking zones, at least one of which cooking zone is designed as a rapid cooking zone.

2. Background Information

Cooking appliances with glass-ceramic hobs are known and have been described in sufficient detail in the patent literature. In such known cooking appliances, the cooking zones are generally heated by means of electrically operated or gas-operated heating devices arranged below the glass-ceramic hob in the region of the cooking zones. These devices may be, for example, electrically operated contact or radiant heating elements or even radiant gas burners.

The cooking appliances with a full-surface flat covering of the hob with a plate made of glass-ceramic have known features of convenience. These features include, in particular, their pleasant appearance and versatility of design, which pleasant appearance and versatility of design can be adapted in an ideal manner to a respective kitchen design with highly variable patterns and coloring. It is also possible to clean the flat plate easily and without difficulty. The plate can, likewise, be used as an additional work surface or a secure place for setting things down. However, the delayed transmission of heat through the plate to the product to be heated in conjunction with a correspondingly lower utilization of energy or efficiency of the heating medium and thus the resulting longer duration up to the boiling point is often considered to be a disadvantage.

In the case of a cooking appliance with gas-operated heating devices, German Patent No. 42 27 672 C2 proposes to overcome the disadvantages described above by the use of at least one open atmospheric gas burner in addition to the customary radiant gas heating elements arranged below the hob. Open atmospheric burners transmit the heat directly and rapidly to the product to be heated, which results in short times to the boiling point. Moreover, the rapid adjustability of open atmospheric gas burners is known and appreciated within the user group. A cooking appliance fitted with at least one "rapid cooking zone" of the type described above thus combines in one unit the advantages of a cooking appliance with a glass-ceramic hob, as described above, with those of a cooking appliance with open atmospheric burners.

A comparable solution would also be desirable in the case of cooking appliances with electrically operated heating devices.

OBJECT OF THE INVENTION

The object of the present invention is to develop electrically operated cooking appliances with glass-ceramic hobs that have the advantages of cooking appliances with a continuous flat glass-ceramic hob, but permit, at least in one cooking zone (a rapid cooking ring) the rapid and direct heating of the product to be heated and the rapid and inertia-free adjustability of the supply of heat, which is not otherwise customary in glass-ceramic hobs.

SUMMARY OF THE INVENTION

The present invention teaches that this object is achieved, in accordance with at least one possible embodiment, in a cooking appliance of the type described above, wherein the cooking zones can be heated essentially by means of electrically operated heating devices, and the rapid cooking ring is formed by a ceramic hot plate which is integrated into the glass-ceramic hob.

European Patent No. 0 069 298 B1 describes the known use of ceramic plates as hot plates in electric cooking appliances. In European Patent No. 0 069 298 B1, reference is made, inter alia, to the particular suitability of silicon nitride as hot plate material on account of its high thermal conductivity and low thermal expansion as well as its high resistance to temperature changes. In accordance with European Patent No. 0 069 298 B1, the hot plate material has a high mechanical strength and can therefore be configured as a thin plate. This results in a low thermal capacity of the plate, which means that rapid inertia-free adjustability of the supply of heat is ensured.

The high thermal conductivity of the ceramic permits a particularly large heat flow through the hot plates to the product to be heated. The heating-up speed, reaction speed and utilization of energy are particularly advantageous.

However, it is not possible on account of the high thermal conductivity of the ceramic, as opposed to cooking appliances with glass-ceramic hobs, to use an integral hob since the heat would then flow away from the hot region. In such a case, the utilization of energy would not be as good, and the temperatures permissible on the frame of the appliance would be exceeded. It is therefore necessary to insert such a ceramic hot plate into a base plate in a thermally insulated manner.

Furthermore, the high thermal conductivity of the ceramic material makes it impossible to form multiple circle cooking rings with diameters or frying pan zones adapted to the cooking pots, with subzones which can be connected and controlled independently of one another, such as have been known and in general use for many years in glass-ceramic hobs. Adjacent zones would heat each other up as well.

Cooking appliances, whose cooking zones are formed solely by ceramic hot plates, such as those described in European Patent No. 0 069 298 B1, despite having several advantages, have a number of disadvantages compared to cooking appliances with glass-ceramic hobs and cooking rings.

One disadvantage of cooking appliances with cooking zones formed solely by ceramic hot plates is that ceramic hot plates display a thermal expansion which cannot be ignored. Since a hot plate made of ceramic expands in operation, if it is joined to brittle materials (e.g. glass, ceramic), no high operating temperatures may occur. Alternatively, the hot plate can be joined to a permanently elastic material. However, these permanently elastic materials are only resistant up to 300° C. Furthermore, the maximum resistance of ceramic plates to thermal hook about 300K.

The operating temperature of ceramic hot plates is thus limited to about 300° C. However, in order to be able to use the ceramic hot plate at these low temperatures, it is necessary to use expensive, special pans with a very flat bottom. In contrast, in the case of commercially available pots, cooking ring temperatures of up to 600° C. are required to bring the product to be heated rapidly to a boil on account of the lack of flatness of the bottoms of the pots.

The integration of at least one hot plate made of ceramic into an otherwise conventional hob made of glass-ceramic, as described above according to the present invention, thus advantageously combines the convenience of the two different systems in one cooking appliance, whereas the respective disadvantages are eliminated to a great extent by the possibility of selection between the two systems, depending on the application.

The advantages of a cooking appliance according to the present invention are summarized here again in brief:

With regard to the glass-ceramic hob:

multiple circle cooking zones with diameters adapted to the cooking pots;

frying pan zones; and possibility of using commercially available pots since operating temperatures up to above 600° C. are possible with glass-ceramic hobs; and With regard to the ceramic hot plate:

good utilization of energy;

short time to boiling; and good adjustability.

Moreover, differing from the known use of radiant gas burners arranged below the hob and open atmospheric burners arranged above or in the hob plane, the advantages of a continuous glass-ceramic hob, such as the possibility of using the hob as a work surface and the possibility of decoration and versatility of design, remain intact in the cooking appliance according to the present invention, since the hot plate according to the present invention is inserted into the hob.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to the embodiments illustrated in the accompanying figures, wherein.

DESCRIPTION OF THE PREFERRED EMBODIMENT

Figure 1:
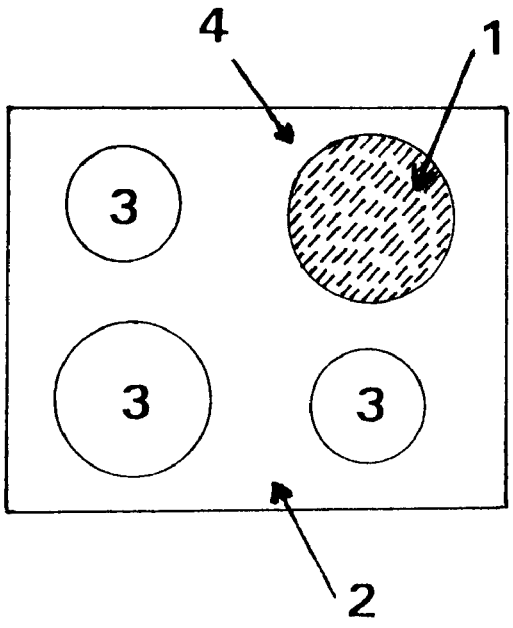
FIG. 1 shows a plan view of a cooking appliance with a glass-ceramic hob, in which a cooking zone (is formed by a ceramic hot plate integrated into the hob.

FIG. 1 shows a hot plate 1 which is inserted into a glass-ceramic hob or cooktop 2. The hot plate 1 can form a so-called rapid cooking zone, while the other cooking zones 3, as is customary in glass-ceramic hobs, are preferably heated by electrically operated heating devices. The electrically operated heating devices are preferably arranged below the glass-ceramic hob or cooktop 2 in the region of the cooking zones 3. Such heating devices may, for example, be contact or radiant heating elements as described above.

The joining 4 between the ceramic hot plate 1 and the glass-ceramic cooktop 2 can be effected using various methods. The ceramic plate or hot plate 1 may, for example, be bonded into the corresponding cutout in the glass-ceramic hob 2 by a silicone adhesive. It is also possible to insert the ceramic plate 1 by means of a thermally insulating material (ceramic, metal, glass). These thermally insulating materials may also serve the purpose of lowering the temperature up to the joining point with the plate material, so that lower stresses occur here or silicone can be used safely for bonding. Cooling elements may also be used for the purpose of lowering the temperature. It is also possible to use ceramic adhesives as a transition to the glass-ceramic cooktop 2, or even to the insulating intermediate material. Materials with negative expansion as joining material can absorb stresses, or a space may be left for the expansion of the ceramic by means of a gap. The gap must be configured in such a way that no water or similar item may penetrate through it into the heating region (e.g. by means of local bonding using silicone adhesives).

In other words, and in accordance with one possible embodiment of the present invention, the ceramic plate 1 can be inserted into the corresponding cutout in the glass-ceramic hob 2 by using a thermally insulating material 6 (see FIG. 2) between the ceramic hot plate 1 and the glass-ceramic cooktop 2. The thermally insulating material 6 can be ceramic, metal, glass or any other suitable thermally insulating material. These thermally insulating materials 6 may also serve the purpose of lowering the temperature at the joining point 5 (see FIG. 2) with the plate material of the glass-ceramic cooktop 2, so that lower stresses occur at the joining point 5. Silicone can be used safely for bonding the thermally insulating material 6 and the glass-ceramic cooktop 2. Cooling elements may also be used for the purpose of lowering the temperature at the joining point 5. It is also possible to use ceramic adhesives as a transition between the ceramic hot plate 1 and the glass-ceramic cooktop 2, the ceramic hot plate 1 and the thermally insulating material 6 and the thermally insulating material 6 and the glass-ceramic cooktop 2. Materials with negative expansion characteristics can be used as the joining material to absorb stresses. Alternatively, a space or gap may be left for the expansion of the ceramic hot plate 1. The gap should preferably be configured in such a way that no water or similar item can penetrate through the gap into the heating region.

Figure 2:
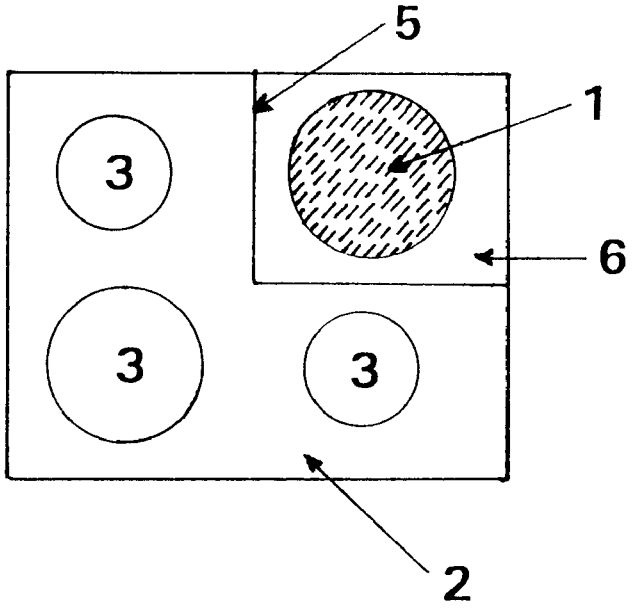
FIG. 2 shows a plan view of a cooking appliance similar to FIG. 1, but the ceramic hot plate is inserted into a plate made of a material with better joining properties, which material is, in turn, inserted into a corresponding cutout in the glass-ceramic hob.

As illustrated in FIG. 2, the construction may also be such that a corner or half of the plate is removed from the glass-ceramic plate or cooktop 2, which glass-ceramic plate 2 is then joined to a different material. The different material can have better joining properties with the ceramic plate 1. The ceramic hot plate 1 can then be fitted into this other material (e.g. toughened glass, glass-ceramic or plastic material).

As already mentioned above, the ceramic material should preferably have a high thermal conductivity. If the material also has electrically insulating properties, for example, $Si_3N_4$ or SiC (silicon nitride or silicon carbide), the heating device can be fitted directly onto the underside of the hot plate 1 in a simple manner in the form of printed-on electrical resistors. The utilization of energy and the heating-up speed are particularly high in this embodiment.

If the ceramic does not have insulating properties, the heating may be effected by commercially available radiant heating elements, such as those used in conventional glass-ceramic hobs.

In one possible embodiment of the present invention, a ceramic or silicone adhesive can be used to join the ceramic hot plate 1 and the glass-ceramic cooktop 2. The ceramic or silicone adhesive can preferably be applied to all the sides of the ceramic hot plate 11 so that, when the ceramic hot plate 1 is inserted into the cutout or opening in the glass-ceramic cooktop 2, the ceramic or silicone adhesive contacts all the adjoining edges of the glass-ceramic cooktop 2. The insertion of the ceramic hot plate 1 into the glass-ceramic cooktop 2 can preferably combine the advantages of both types of cooking elements while still providing a smooth, continuous surface for cooking food and any other tasks.

In another possible embodiment of the present invention, a ceramic or silicone adhesive can be used to join the ceramic hot plate 1 and the thermally insulating material 6. The ceramic or silicone adhesive can preferably be applied to all the sides of the ceramic hot plate 1, so that, when the ceramic hot plate 1 is joined with the thermally insulating material 6, the ceramic or silicone adhesive contacts all the adjoining edges of the thermally insulating material 6. The thermally insulating material 6, with the ceramic hot plate 1, can then be inserted into the cutout in the glass-ceramic cooktop 2 and joined to the glass-ceramic cooktop 2 by a ceramic or silicone adhesive. The thermally insulating material 6 can be designed to form a good bond with the ceramic hot plate 1 and to limit the transfer of heat from the ceramic hot plate 1 to the glass-ceramic hob 2. The use of the thermally insulating material 6 can also permit an easier installation of the ceramic hot plate 1 into the glass-ceramic cooktop 2 than without the thermally insulating material 6 because of the thermally insulating material 6 will preferably require a less precise opening or cutout in the glass-ceramic hob 2. The insertion of the thermally insulating material 6 with the ceramic hot plate 1 into the glass-ceramic cooktop 2 can also preferably combine the advantages of both types of cooking elements while still providing a smooth, continuous surface for cooking food and any other tasks.

In yet another possible embodiment of the present invention, the cooking rings, areas or zones 3 of the glass-ceramic cooktop 2 could be heated by one of several different types of heat sources. Some of these heat sources could include radiant heating elements, induction heating elements or any other similar type of heating element.

In still another possible embodiment of the present invention, the glass-ceramic cooktop 2 with the ceramic hot plate 1 can be used with a stove, range or other cooking appliance. The glass-ceramic cooktop 2 can be mounted or positioned on a housing of the stove. The stove or cooking appliance can also have an oven, a broiler or any other type of similar feature. The stove or cooking appliance with the glass-ceramic cooktop 2 and ceramic hot plate 1 part can be used for the preparation of food and other items in a commercial and/or residential environment.

One feature of the invention resides broadly in the cooking appliance with a glass-ceramic hob having a plurality of cooking rings, at least one of which is designed as a rapid cooking zone characterized in that the cooking zones 1, 3 can be heated essentially by means of electrically operated heating devices, and the rapid cooking zone is formed by a ceramic hot plate 1 which is integrated into the glass-ceramic hob 2.

Another feature of the invention resides broadly in the cooking appliance characterized in that the ceramic hot plate 1 is inserted directly into the glass-ceramic hob 2.

Yet another feature of the invention resides broadly in the cooking appliance characterized in that the ceramic hot plate is bonded into a corresponding cutout in the glass-ceramic hob by means of a silicone adhesive.

Still another feature of the invention resides broadly in the cooking appliance characterized in that the ceramic hot plate 1 is inserted into a plate made of thermally insulating ceramic, made of metal or made of toughened glass 6, which plate is, in turn, inserted into a cutout in the glass-ceramic hob 2.

A further feature of the invention resides broadly in the cooking appliance characterized in that the ceramic hot plate 1 consists of $Si_3N_4$ or SiC.

Some examples of stoves and ranges which may possibly be utilized or adapted for use in the context of the present invention may be disclosed in the following U.S. Pat. No. 5,213,091, issued on May 25, 1993; U.S. Pat. No. D336,210, issued on Jun. 8, 1993; U.S. Pat. No. 5,280,152, issued on Jan. 18, 1994; U.S. Pat. No. 5,290,997, issued on Mar. 1, 1994; U.S. Pat. No. 5,400,765, issued on Mar. 28, 1995; U.S. Pat. No. D359,345, issued on Jun. 13, 1995; U.S. Pat. No. D361,015, issued on Aug. 8, 1995; and U.S. Pat. No. 5,464,005, issued on Nov. 7, 1995.

Some examples of burners and related components which may possibly be utilized or adapted for use in the context of the present invention may be disclosed in the following U.S. Pat. No. 4,758,710, issued on Jul. 19, 1988; U.S. Pat. No. 4,899,723, issued on Feb. 13, 1990; U.S. Pat. No. 5,186,158, issued on Feb. 16, 1993; U.S. Pat. No. D333,943, issued on Mar. 16, 1993; U.S. Pat. No. 5,323,759, issued on Jun. 28, 1994; U.S. Pat. No. 5,329,918, issued on Jul. 19, 1994; U.S. Pat. No. 5,397,234, issued on Mar. 14, 1995; U.S. Pat. No. 5,397,873, issued on Mar. 14, 1995; U.S. Pat. No. 5,400,765, issued on Mar. 28, 1995; and U.S. Pat. No. 5,437,262, issued on Aug. 1, 1995;

Some examples of related components for stoves and ranges which may possibly be utilized or adapted for use in the context of the present invention may be disclosed in the following U.S. Pat. No. 5,220,155, issued on Jun. 15, 1993; U.S. Pat. No. 5,245,159, issued on Sep. 14, 1993; U.S. Pat. No. 5,343,020, issued on Aug. 30, 1994; U.S. Pat. No. 5,377,660, issued on Jan. 3, 1995; U.S. Pat. No. 5,380,985, issued on Jan. 10, 1995; and U.S. Pat. No. 5,400,766, issued on Mar. 28, 1995.

Some examples of cooking hobs and cooktops which may possibly be utilized or adapted for use in the context of the present invention may be disclosed in the following U.S. Pat. No. 5,406,932, issued on Apr. 18, 1995; U.S. Pat. No. 5,422,460, issued on Jun. 6, 1995; U.S. Pat. No. 5,424,512, issued on Jun. 13, 1995; U.S. Pat. No. 5,425,353, issued on Jun. 20, 1995; U.S. Pat. No. 5,429,114, issued on Jul. 4, 1995; and U.S. Pat. No. 5,448,036, issued on Sep. 5, 1995;

Some examples of ceramic plates or hot plates which may possibly be utilized or adapted for use in the context of the present invention may be disclosed in the following U.S. Pat. No. 3,596,650, issued on Aug. 3, 1971; U.S. Pat. No. 3,870,861, issued on Mar. 11, 1975; U.S. Pat. No. 4,414,465, issued on Nov. 8, 1983; U.S. Pat. No. 4,634,841, issued on Jan. 6, 1987; and U.S. Pat. No. 5,397,873, issued on Mar. 14, 1995.

Some examples of resistors printed on or disposed on a ceramic material which may possibly be utilized or adapted for use in the context of the present invention may be disclosed in the following U.S. Pat. No. 4,004,130, issued on Jan. 18, 1977; U.S. Pat. No. 4,160,897, issued on Jul. 10, 1979; U.S. Pat. No. 4,762,982, issued on Aug. 9, 1988; U.S. Pat. No. 5,264,681, issued on Nov. 23, 1993; and U.S. Pat. No. 5,700,338, issued on Dec. 23, 1997.

Some examples of ceramic materials which may possibly be utilized or adapted for use in the context of the present invention may be disclosed in the following U.S. Pat. No. 5,385,873, issued on Jan. 31, 1995; U.S. Pat. No. 5,407,740, issued on Apr. 18, 1995; U.S. Pat. No. 5,420,399, issued on May 30, 1995; U.S. Pat. No. 5,422,319, issued on Jun. 6, 1995; U.S. Pat. No. 5,449,649, issued on Sep. 12, 1995; U.S.

Pat. No. 5,476,684, issued on Dec. 19, 1995; and U.S. Pat. No. 5,691,261, issued on Nov. 25, 1997.

Some examples of adhesive materials which may possibly be utilized or adapted for use in the context of the present invention may be disclosed in the following U.S. Pat. No. 5,225,662, issued on Jul. 6, 1993; U.S. Pat. No. 5,268,338, issued on Dec. 7, 1993; U.S. Pat. No. 5,288,674, issued on Feb. 22, 1994; U.S. Pat. No. 5,300,627, issued on Apr. 5, 1994; U.S. Pat. No. 5,403,228, issued on Apr. 4, 1995; U.S. Pat. No. 5,432,320, issued on Jul. 11, 1995; U.S. Pat. No. 5,468,290, issued on Nov. 21, 1995; and U.S. Pat. No. 5,475,044, issued on Dec. 12, 1995.

Some examples of thermally insulating materials which may possibly be utilized or adapted for use in the context of the present invention may be disclosed in the following U.S. Pat. Nos. 5,408,832, issued on Apr. 25, 1995; U.S. Pat. No. 5,420,401, issued on May 30, 1995; U.S. Pat. No. 5,449,232, issued on Sep. 12, 1995; U.S. Pat. No. 5,456,682, issued on Oct. 10, 1995; and U.S. Pat. No. 5,469,683, issued on Nov. 28, 1995.

German Patent No. 30 49 491 C2, German Patent No. 42 27 672 C2, French Patent No. 2 626 964, European Patent No. 0 069 298 B1 and German Patent Application No. 197 05 715.2-16 are hereby incorporated as if set forth in their entirety herein.

U.S. patent application Ser. No. 09/022,466, filed on or about Feb. 13, 1998, having the title "Cooking Unit, such as a Stove, for Cooking Food", having inventors Martin Taplan, Herwig Scheidler, and Christof Köster and claiming priority from German Patent Application Numbers 197 O5 715.2-16, DE-OS 197 05 715.2-16 and DE-PS 197 05 715.2-16 filed on Feb. 14, 1997 is hereby incorporated as if set forth in its entirety herein.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 297 02 418.3, filed on Feb. 13, 1997, having inventors Dr. Peter Nass, Dr. Patrick Hoyer, and Dr. Kurt Schaupert, and DE-OS 297 02 418.3 and DE-PS 297 02 418.3, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A stove for cooking food, said stove comprising:

a housing;

a hob;

said hob comprising a glass-ceramic material;

said glass-ceramic hob being disposed on said housing;

said glass-ceramic hob being configured and disposed to form a continuous cooking surface on which to place cooking utensils;

said glass-ceramic hob comprising a plurality of cooking zones;

each of said plurality of cooking zones being configured and disposed to receive a cooking utensil;

at least one of said plurality of cooking zones comprising a ceramic hot plate;

said at least one ceramic hot plate being integrated into said glass-ceramic hob;

at least one of said plurality of cooking zones other than said at least one cooking zone comprising a ceramic hot plate, comprising a glass-ceramic heating area;

said at least one ceramic hot plate being configured to heat substantially more rapidly than said at least one glass-ceramic heating area;

said at least one ceramic hot plate and the area of said glass-ceramic hob about said at least one ceramic hot plate together forming said continuous cooking surface; and each of said plurality of cooking zones comprising an electrically operated heating device.

2. The stove according to claim 1, wherein said ceramic hot plate comprises a ceramic material having a substantially higher thermal conductivity than said glass-ceramic material.

3. The stove according to claim 2, wherein:

said glass-ceramic hob comprises at least one opening; and each said at least one ceramic hot plate is disposed in a corresponding one of said at least one opening in said glass-ceramic hob.

4. The stove according to claim 3, wherein said at least one ceramic hot plate is bonded to said glass-ceramic hob by an adhesive.

5. The stove according to claim 4, wherein said adhesive comprises one of a silicone adhesive and a ceramic adhesive.

6. The stove according to claim 5, wherein said at least one ceramic hot plate comprises one of $Si_3N_4$ and SiC.

7. The stove according to claim 1, further comprising:

said glass-ceramic hob comprises a plate;

said at least one ceramic hot plate being disposed in said plate;

said glass-ceramic hob comprising an opening; and said plate being disposed in said opening of said glass-ceramic hob.

8. The stove according to claim 7, wherein said plate comprises a thermally insulating material.

9. The stove according to claim 8, wherein said thermally insulating material comprises one of ceramic, metal and toughened glass.

10. The stove according to claim 9, wherein said at least one ceramic hot plate comprises one of $Si_3N_4$ and SiC.

11. A cooking appliance for cooking food, said cooking appliance comprising:

a hob;

said hob comprising a glass-ceramic material;

said glass-ceramic hob being configured and disposed to form a substantially continuous cooking surface on which to place cooking utensils;

said glass-ceramic hob comprising a plurality of cooking zones;

each of said plurality of cooking zones being configured and disposed to receive a cooking utensil;

at least one of said plurality of cooking zones comprising a ceramic hot plate;

said at least one ceramic hot plate being integrated into said glass-ceramic hob;

at least one of the other cooking zones, other than said at least one cooking zone, comprising a ceramic hot plate comprising a glass-ceramic heating area;

said at least one ceramic hot plate being configured to heat substantially more rapidly than said at least one glass-ceramic heating area;

said at least one ceramic hot plate and the area of said glass-ceramic hob about said at least one ceramic hot plate together forming said substantially continuous cooking surface; and each of said plurality of cooking zones comprising an electrically operated heating device.

12. The cooking appliance according to claim 11, wherein said ceramic hot plate comprises a ceramic material having a substantially higher thermal conductivity than said glass-ceramic material.

13. The cooking appliance according to claim 12, wherein:

said glass-ceramic hob comprises at least one opening; and each said at least one ceramic hot plate is disposed in a corresponding one of said at least one opening in said glass-ceramic hob.

14. The cooking appliance according to claim 13, wherein:

said at least one ceramic hot plate is bonded to said glass-ceramic hob by one of a silicone adhesive and a ceramic adhesive; and said at least one ceramic hot plate comprises one of $Si_3N_4$ and SiC.

15. The cooking appliance according to claim 11, further comprising:

said glass-ceramic hob comprises a plate;

said plate comprising a thermally insulating material;

said thermally insulating material comprising one of ceramic, metal and toughened glass;

said at least one ceramic hot plate being disposed in said plate;

said glass-ceramic hob comprising an opening;

said plate being disposed in said opening of said glass-ceramic hob; and said at least one ceramic hot plate comprising one of $Si_3N_4$ and SiC.

16. A stove for cooking food, said stove comprising:

a housing;

a cooktop;

said cooktop comprising a glass-ceramic material;

said glass-ceramic cooktop being disposed on said housing;

said glass-ceramic cooktop being configured and disposed to form a continuous cooking surface on which to place cooking utensils;

said glass-ceramic cooktop comprising a plurality of cooking zones;

each of said plurality of cooking zones being configured and disposed to receive a cooking utensil;

at least one of said plurality of cooking zones comprising a ceramic hot plate;

said at least one ceramic hot plate being integrated into said glass-ceramic cooktop;

at least one of said plurality of cooking zones, other than said at least one cooking zone comprising a ceramic hot plate, comprising a glass-ceramic heating area; and said at least one ceramic hot plate and the area of said glass-ceramic cooktop about said at least one ceramic hot plate together forming said continuous cooking surface.

17. The stove according to claim 16, wherein:

said at least one ceramic hot plate comprises a rapid heating and cooking hot plate; and said at least one ceramic hot plate is configured to heat substantially more rapidly than said at least one glass-ceramic heating area.

18. The stove according to claim 17, wherein:

said ceramic hot plate comprises a ceramic material having a substantiality higher thermal conductivety than said glass-ceramic material; and each of said plurality of cooking zones comprises an electrically operated heating device.

19. The stove according to claim 18, wherein:

said glass-ceramic cooktop comprises at least one opening; and each said at least one ceramic hot plate is disposed in a corresponding one of said at least one opening in said glass-ceramic cooktop;

said at least one ceramic hot plate is bonded to said glass-ceramic cooktop by one of a silicone adhesive and a ceramic adhesive; and said at least one ceramic hot plate comprises one of $Si_3N_4$ and SiC.

20. The stove according to claim 18, further comprises:

said glass-ceramic cooktop comprises a plate;

said plate comprises a thermally insulating material;

said thermally insulating material comprises one of ceramic, metal and toughened glass;

said at least one ceramic hot plate is disposed in said plate;

said glass-ceramic cooktop comprises an opening;

said plate is disposed in said opening of said glass-ceramic cooktop; and said at least one ceramic hot plate comprises one of $Si_3N_4$ and SiC.

* * * * *

UNITED STATES PATENT AND TRADEMARK OFFICE

CERTIFICATE OF CORRECTION

PATENT NO. : 6,002,112

DATED : December 14, 1999

INVENTOR(S) : Peter NASS, Patrick HOYER and Kurt SCHAUPERT

It is certified that error appears in the above-identified patent and that said Letters Patent is hereby corrected as shown below:

In column 2, line 54, after 'thermal', delete "hook" and insert --shock is typically--.

In column 5, line 3, after the first occurrence of 'plate', delete "11" and insert --1,--.

Signed and Sealed this

Ninth Day of January, 2001

*Attest:*

*Attesting Officer*

Q. TODD DICKINSON

*Commissioner of Patents and Trademarks*